US007040001B1

(12) United States Patent
Chuang

(10) Patent No.: US 7,040,001 B1
(45) Date of Patent: May 9, 2006

(54) METAL ENCAUSTIC TILE MAKING MACHINE

(76) Inventor: Sen-Jung Chuang, No.90-10, Hsia Kwei Jou San, Tan Shui Chen, Taipei Hsien (TW)

( * ) Notice: Subject to any disclaimer, the term of this patent is extended or adjusted under 35 U.S.C. 154(b) by 182 days.

(21) Appl. No.: 10/843,327

(22) Filed: May 12, 2004

(51) Int. Cl.
*B21D 13/10* (2006.01)
*B23P 23/00* (2006.01)

(52) U.S. Cl. ..... 29/564; 29/34 R; 29/563; 29/564.6; 72/307; 72/311; 72/385; 72/379.6

(58) Field of Classification Search ..... 29/564, 29/34 R, 563, 564.6, 564.8, 895.3, 421.1, 29/527.1; 72/301, 307, 308, 309, 311, 385, 72/386, 379.6, 177, 130
See application file for complete search history.

(56) References Cited

U.S. PATENT DOCUMENTS 3,696,655 A * 10/1972 Hinks et al. ..... 72/311
3,709,096 A * 1/1973 Stender-Robertz ..... 409/183
4,092,842 A * 6/1978 Oser et al. ..... 72/379.6
4,237,598 A * 12/1980 Williamson ..... 29/564
4,250,728 A * 2/1981 King ..... 72/177
4,444,037 A * 4/1984 Norgate ..... 72/177
4,621,410 A * 11/1986 Williamson ..... 29/564
4,988,261 A * 1/1991 Blatt ..... 414/749.1
5,509,777 A * 4/1996 Crorey et al. ..... 198/375
6,192,731 B1 * 2/2001 Toivanen ..... 72/307
6,497,131 B1 * 12/2002 Feijen ..... 72/385
6,957,558 B1 * 10/2005 Chuang ..... 72/130
2001/0037552 A1 * 11/2001 Bareis et al. ..... 29/34 R

* cited by examiner

*Primary Examiner*—Boyer D. Ashley
*Assistant Examiner*—Dana Ross
(74) *Attorney, Agent, or Firm*—Troxell Law Office, PLLC

(57) ABSTRACT

A metal encaustic tile making machine includes a machine base, a corrugation forming roller unit controlled to corrugate a continuous sheet of metal sheet material into a corrugated metal sheet, an angle forming unit controlled to stamp the corrugated metal sheet into a metal encaustic tile having angles, a cutting unit controlled to cut the finished metal encaustic tile from the continuous sheet of metal sheet material, a slide carrying the angle forming unit and the cutting unit on the machine base, and a motor controlled to move the slide forwards/backwards along two parallel guide rails at the machine base via a transmission screw to fit the delivering speed of the continuous sheet of metal sheet material.

2 Claims, 9 Drawing Sheets

METAL ENCAUSTIC TILE MAKING MACHINE

BACKGROUND AND SUMMARY OF THE INVENTION

The present invention relates to a machine for making tiles and more particularly, to a metal encaustic tile making machine, which uses a slide to carry an angle forming unit and a cutting unit on the machine base such that delivery of continuous sheet of metal sheet material keeps running during working of the angle forming unit and the cutting unit.

In a conventional metal encaustic tile making machine, a continuous sheet of metal sheet material is delivered forwards at a constant speed to a corrugation forming roller unit for processing into a corrugated metal sheet. When operating the first mold and second mold of the angle forming unit of the encaustic tile making machine to make angles at the corrugated metal sheet, the feeding of the continuous sheet of metal sheet material must be stopped. This metal encaustic tile making procedure is complicated, resulting in low efficiency.

The present invention has been accomplished under the circumstances in view. It is therefore the main object of the present invention to provide a metal encaustic tile making machine, which eliminates the drawback of the aforesaid prior art design. To achieve this and other objects of the present invention, the metal encaustic tile making machine comprises a machine base, a corrugation forming roller unit adapted to corrugate a continuous sheet of metal sheet material into a corrugated metal sheet, an angle forming unit adapted to stamp the corrugated metal sheet into a metal encaustic tile having angles, a cutting unit adapted to cut the finished metal encaustic tile from the continuous sheet of metal sheet material, two parallel guide rails provided at the machine base, a slide coupled to and movable along the guide rails and carrying the angle forming unit and the cutting unit on the machine base, a transmission screw pivotally mounted in the machine base, a coupling block fixedly provided at a bottom side of the slide and threaded onto the transmission screw, and a reversible motor mounted inside the machine base and adapted to rotate the transmission screw and to further move the slide with the angle forming unit and the cutting unit on the machine base along the guide rails. Therefore, it is not necessary to stop delivering of the continuous sheet of metal sheet material during working of the angle forming unit and the cutting unit.

DETAILED DESCRIPTION OF THE INVENTION

Figure 2:
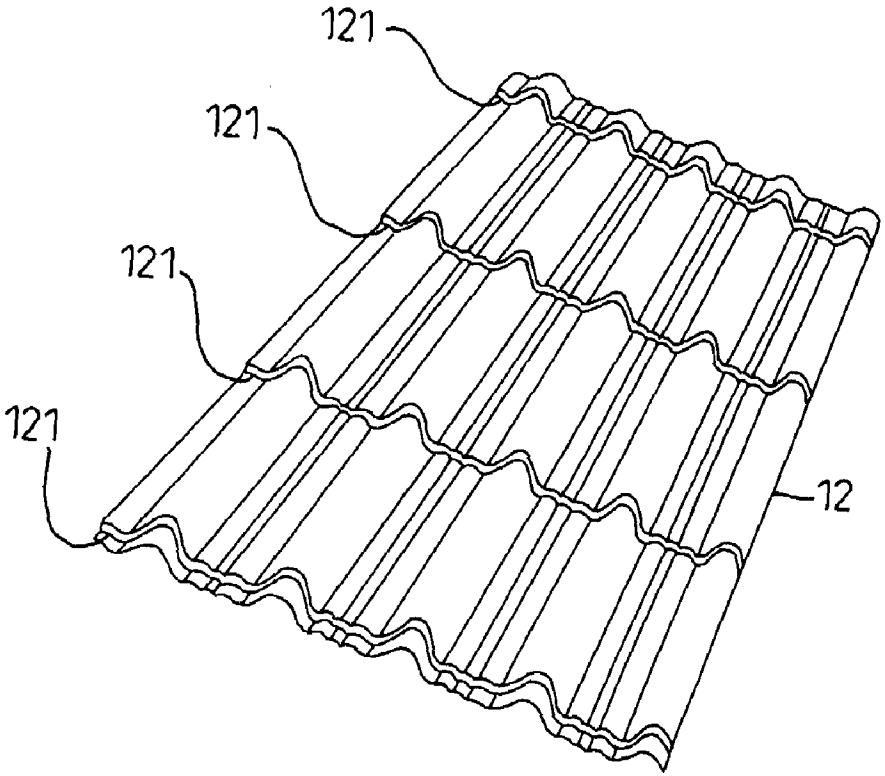
FIG. 2 is an elevational view of a metal encaustic tile made through a metal encaustic tile making machine according to the present invention.
Figure 1:
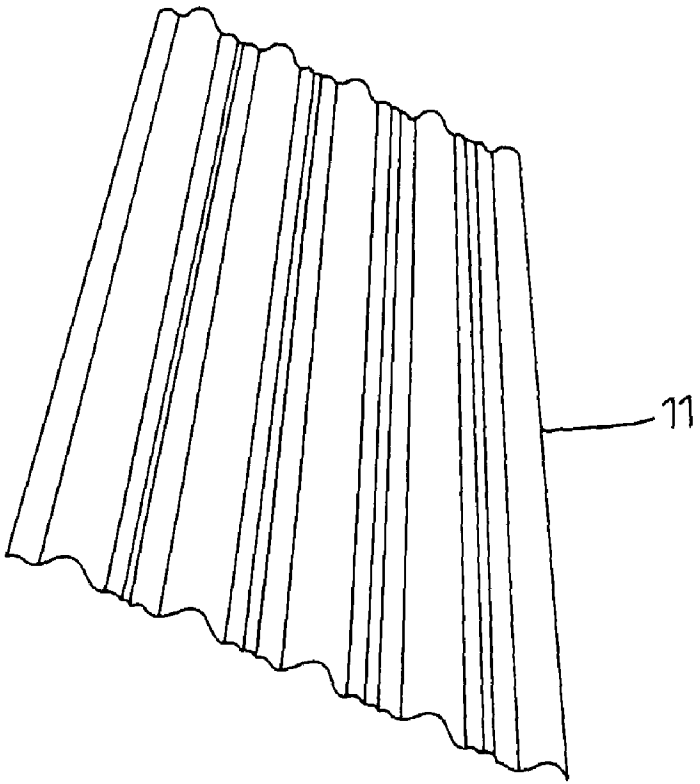
FIG. 1 is an elevational view of a corrugated metal sheet processed through the corrugation forming roller unit of a metal encaustic tile making machine according to the present invention.
Figure 3:
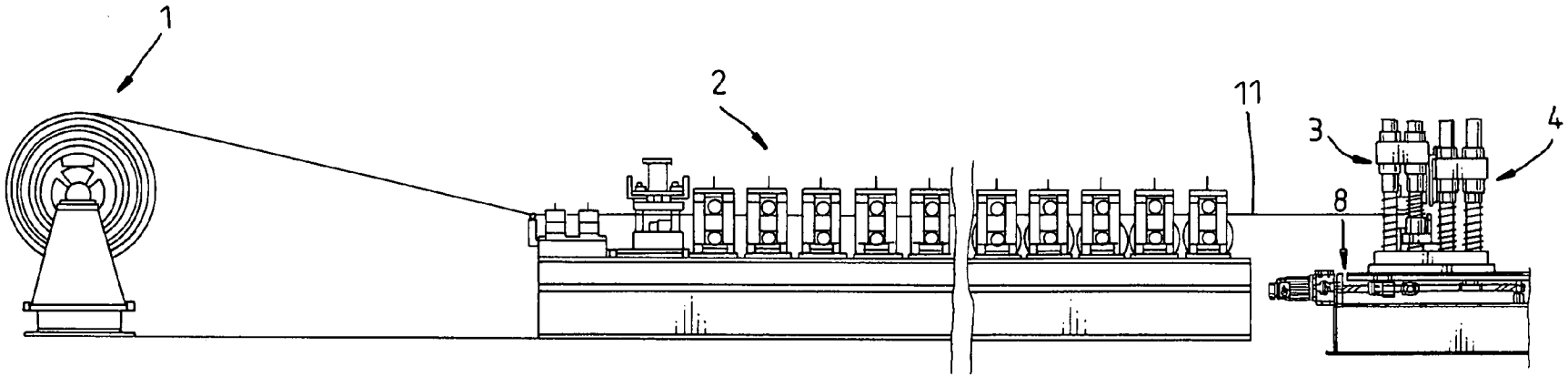
FIG. 3 is front plain view of a metal encaustic tile making machine according to the present invention.
Figure 4:
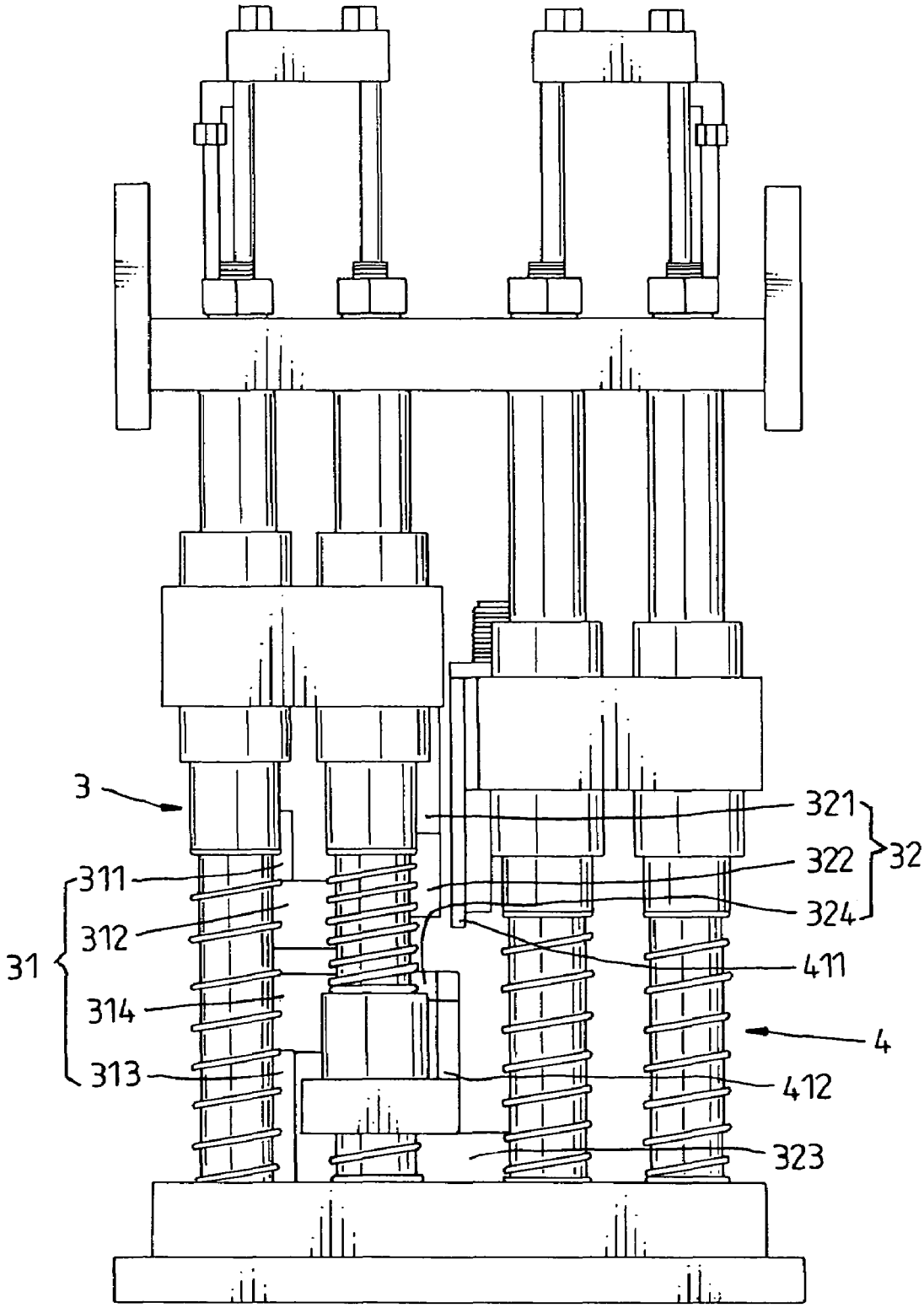
FIG. 4 is a front view in an enlarged scale of a part of the metal encaustic tile making machine shown in FIG. 3, showing the structure of the angle forming unit and the cutting unit.
Figure 5:
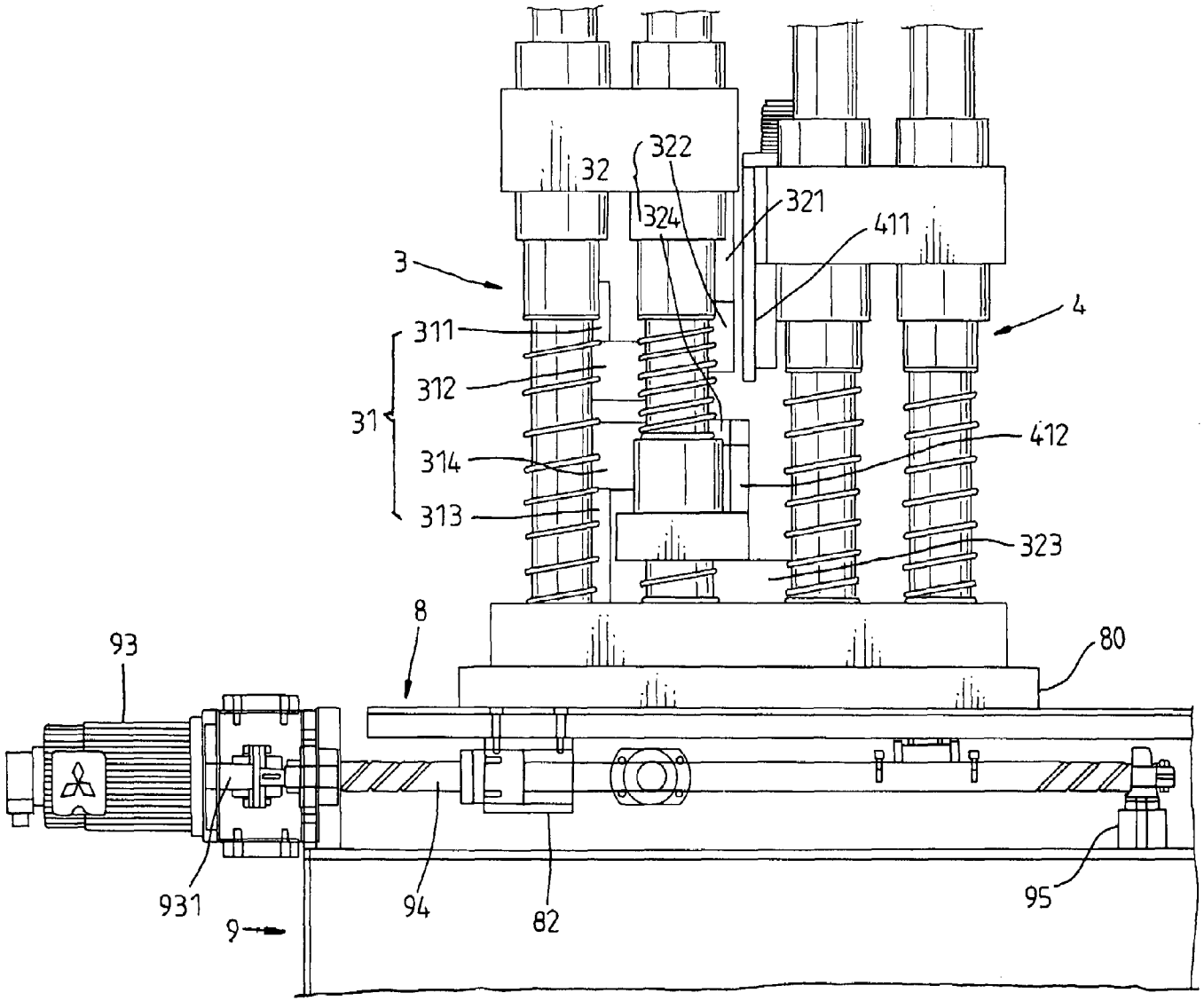
FIG. 5 is a front view in an enlarged scale of a part of the metal encaustic tile making machine shown in FIG. 3, showing the angle forming unit and the cutting unit carried on the slide.

Referring to FIGS. 1–8, a metal encaustic tile making machine in accordance with the present invention comprises a corrugation forming roller unit 2 (see FIG. 3), which is controlled to corrugate a continuous sheet of metal sheet material 1 into a corrugated metal sheet 11 (see FIG. 1), an angle forming unit 3, which comprises a first mold 31 and a second mold 32 (see FIG. 4) and controlled to stamp the corrugated metal sheet 11 into a metal encaustic tile 12 having angles 121 that are arranged in parallel and extend across the corrugations of the corrugated metal sheet 11 (see FIG. 2), and a cutting unit 4, which is controlled to cut the finished metal encaustic tile 12 from the continuous sheet of metal sheet material 1.

The main features of the present invention are outlined hereinafter. The metal encaustic tile making machine further comprises a machine base 9, and a slide 8 slidably carrying the angle forming unit 3 and the cutting unit 4 on the machine base 9. The slide 8 comprises two first coupling blocks 81 provided at the bottom side and coupled to parallel guide rails 92 at the machine base 9, a second coupling block 82 provided at the bottom side and threaded onto a screw rod 94, which has one end supported in a screw holder 95 at the machine base 9 and the other end coupled to the output shaft 931 of a reversible motor 93 in the machine base 9 (see FIGS. 5 and 6). Rotating the reversible motor 93 forwards/backwards causes the slide 8 to carry the angle forming unit 3 and the cutting unit 4 forwards/backwards on the machine base 9 at a predetermined speed that fits the delivering speed of the corrugated metal sheet 11. By means of controlling the slide 8 to carry the angle forming unit 3 and the cutting unit 4 on the machine base 9 at a predetermined speed that fits the delivering speed of the corrugated metal sheet 11, the first mold 31 and second mold 32 of the angle forming unit 3 and the cutting unit 4 are continuously operated to work the corrugated metal sheet 11.

Figure 6:
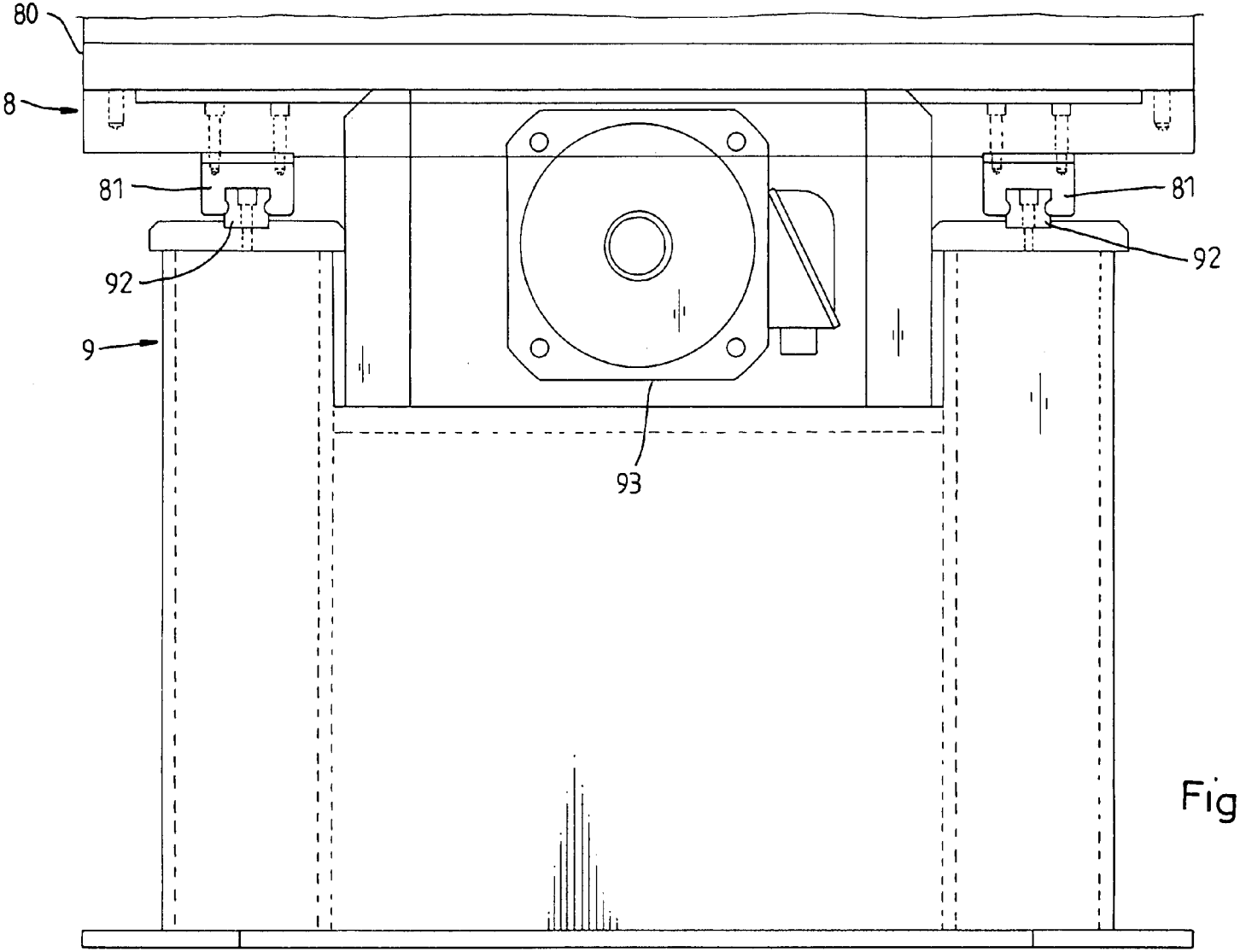
FIG. 6 is a side view in an enlarged scale of a part of the metal encaustic tile making machine shown in FIG. 3, showing the slide coupled to the guide rails.
Figure 7:
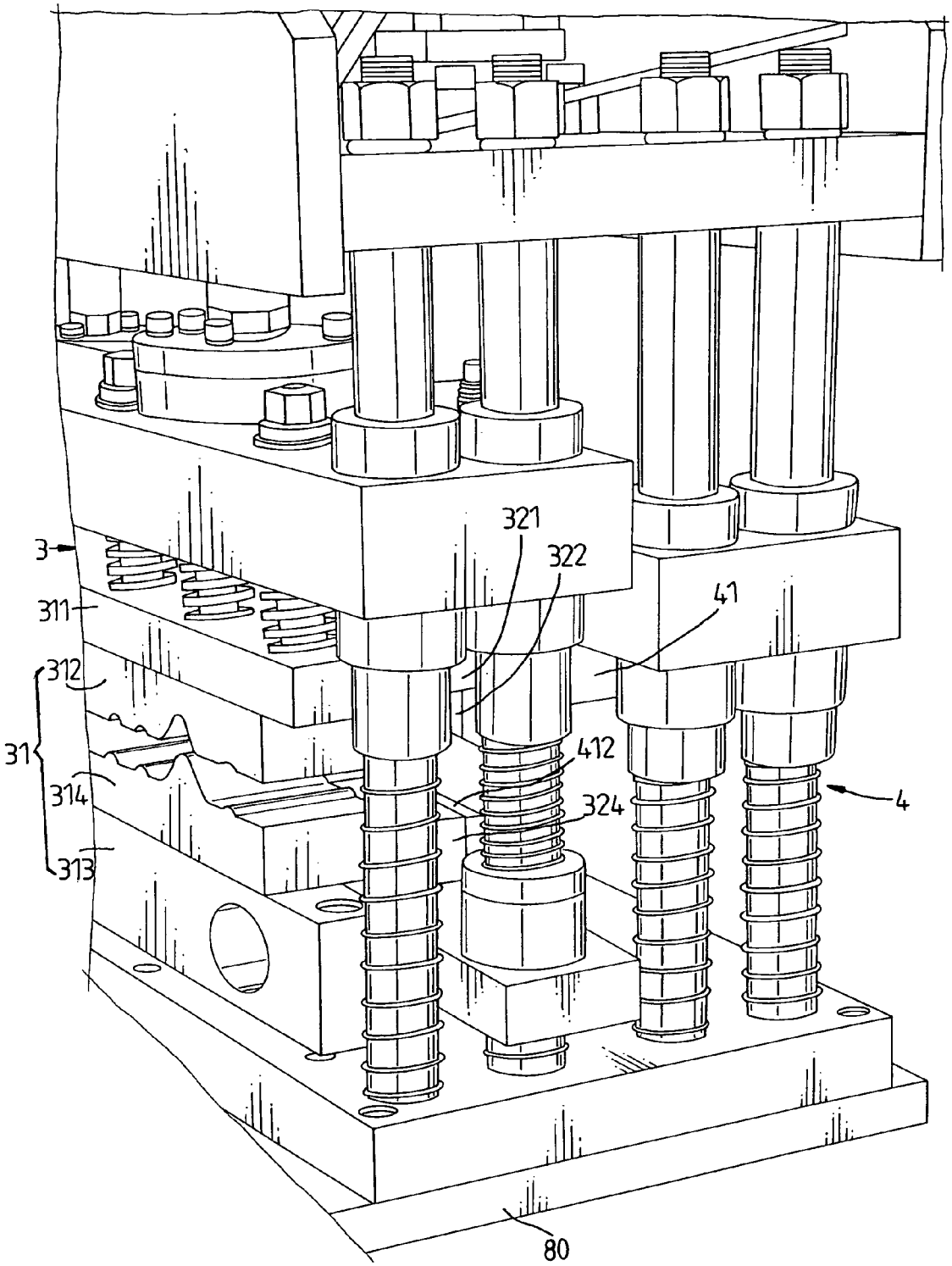
FIG. 7 is a perspective view in an enlarged scale of a part of the metal encaustic tile making machine shown in FIG. 3, showing the arrangement of the angle forming unit and the cutting unit on the slide.

The aforesaid angle forming unit 3 and the cutting unit 4 are mounted on the locating block 80, which is fixedly fastened top the top side of the slide 8 (see FIGS. 6 and 7).

Figure 8:
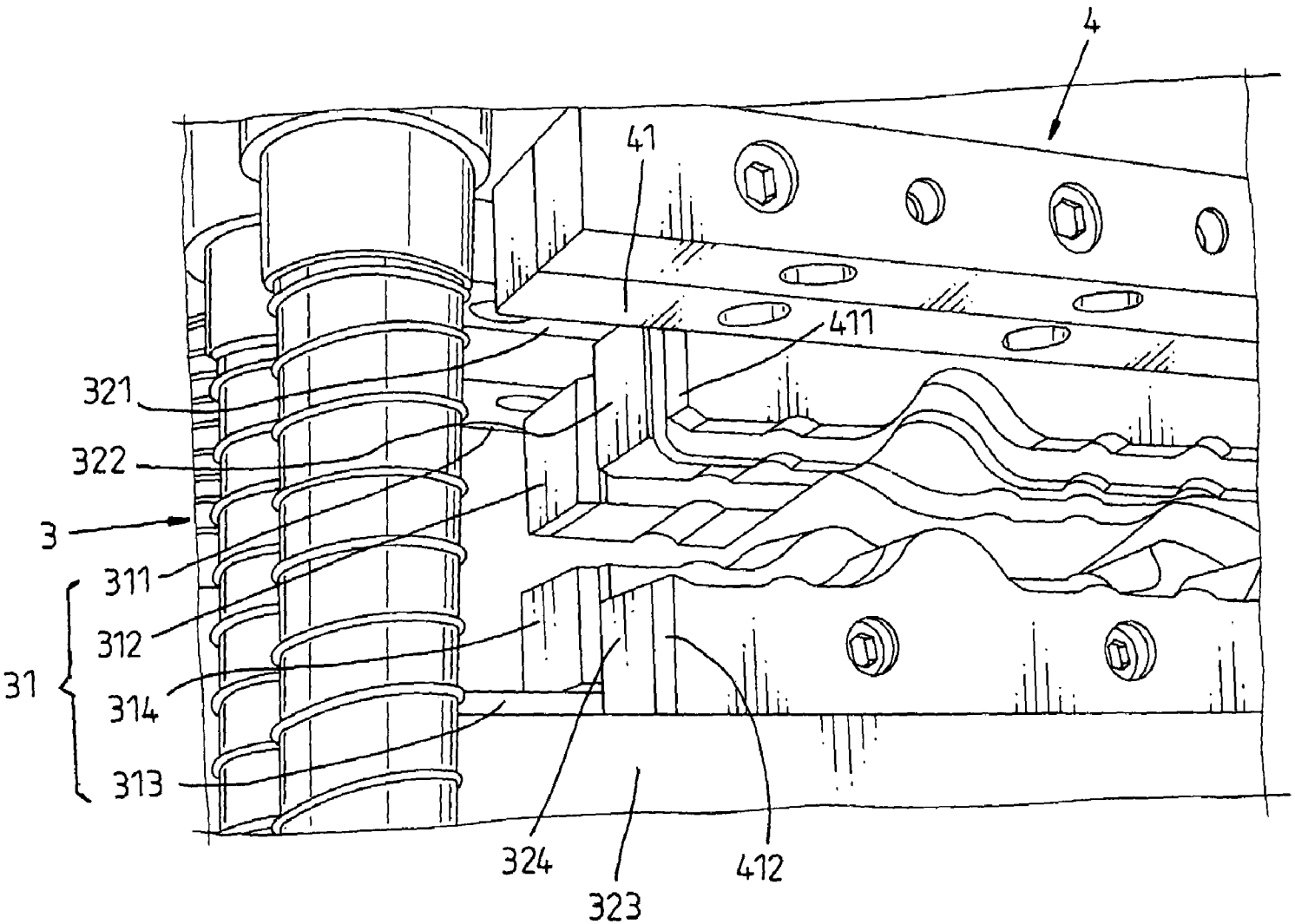
FIG. 8 is an enlarged view of a part of FIG. 7.

Referring to FIGS. 7 and 8, the first mold 31 of the angle forming unit 3 comprises an upper die block holder 311, an upper die block 312 fixedly fastened to the bottom side of the upper die block holder 311, a bottom die block holder 313 vertically aimed at the upper die block holder 311, and a bottom die block 314 fixedly fastened to the top side of the bottom die block holder 313. The second mold 32 of the angle forming unit 3 comprises an upper die block holder

321, an upper die block 322 fixedly fastened to the bottom side of the upper die block holder 321, a bottom die block holder 323 vertically aimed at the upper die block holder 321, and a bottom die block 324 fixedly fastened to the top side of the bottom die block holder 323.

The cutting unit 4 comprises an upper cutter holder 41, an upper cutter 411 fixedly fastened to the upper cutter holder 41 at an inner side, and a bottom cutter 412 fixedly fastened to the bottom die block 324 of the second mold 32 at a front side.

Figure 9:
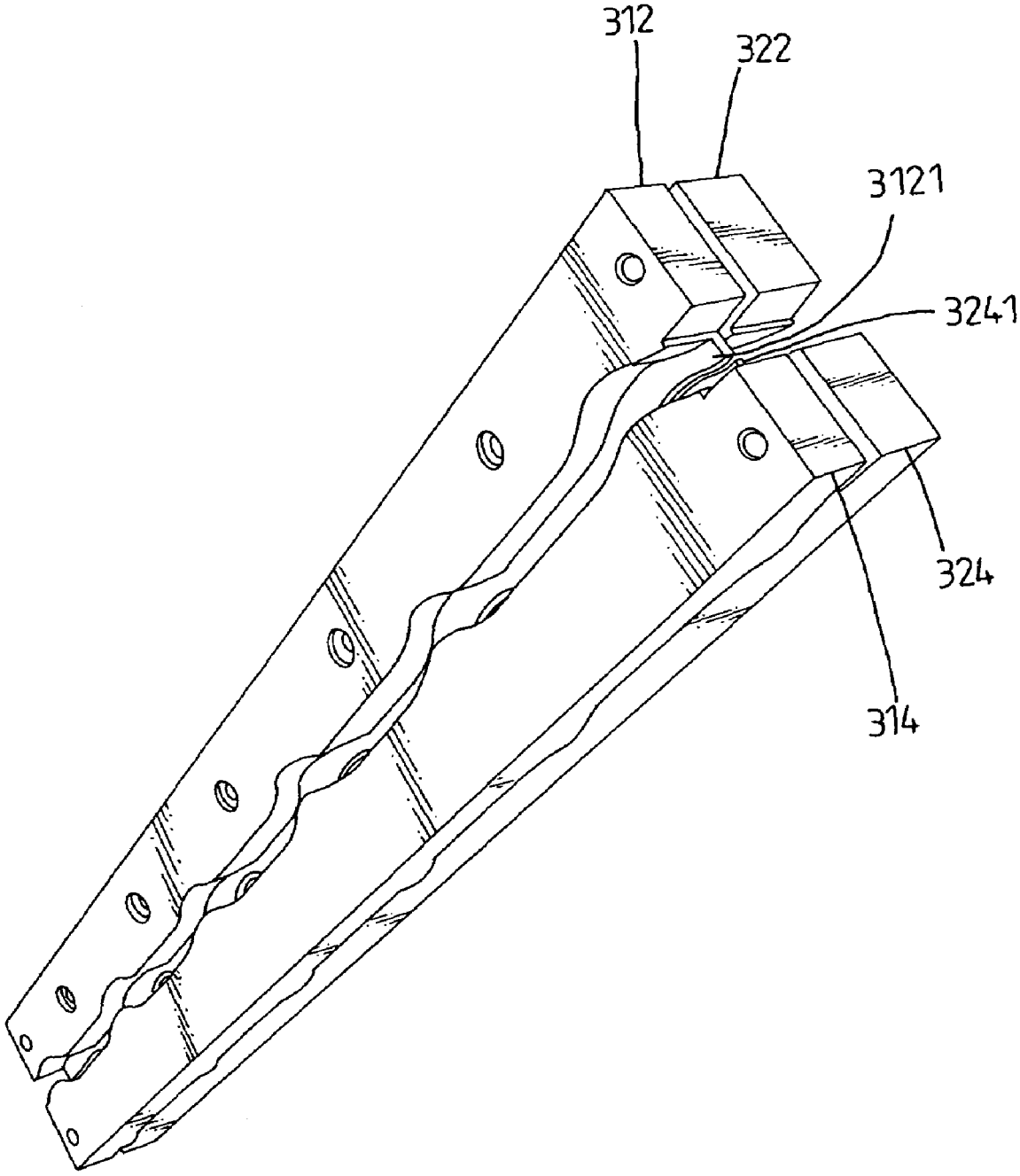
FIG. 9 shows an alternate form of the angle forming unit according to the present invention.
Figure 11:
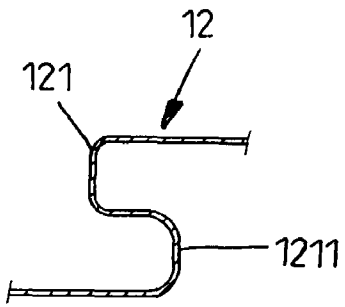
FIG. 11 is an enlarged view of a part of FIG. 10.
Figure 10:
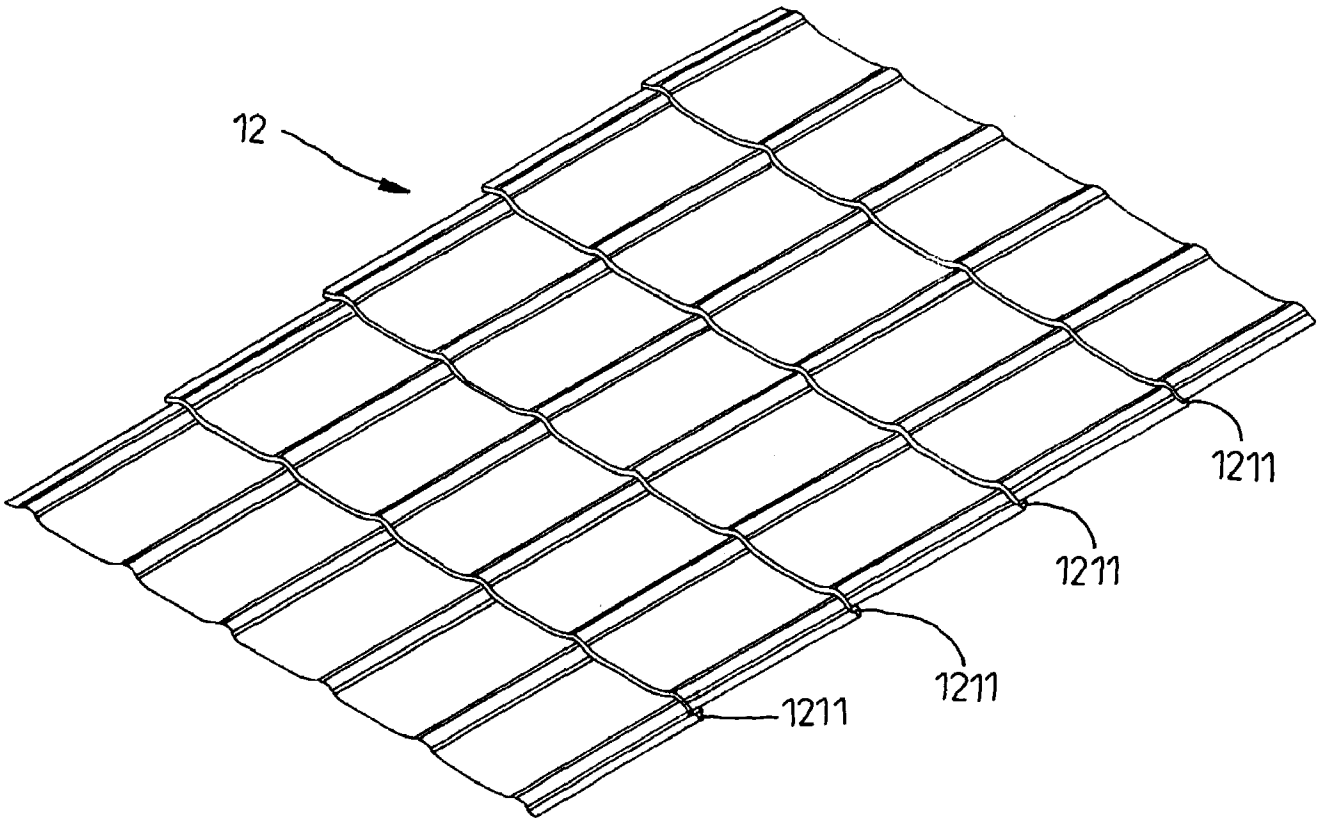
FIG. 10 an elevational view of a metal encaustic tile processed through the angle forming unit shown in FIG. 9.

Referring to FIGS. 9~11, the positions of the upper die blocks 312, 322 of the first and second molds 31, 32 of the angle forming unit 3 may be exchanged with the bottom die blocks 314, 324 respectively to make a different shape of angles 121 at the metal encaustic tile 12. The upper die block 312 of the first mold 31 comprises a rear bottom rib 3121. The bottom die block 324 of the second mold 32 comprises a front top rib 3241. By means of the bottom rear 3121 of the upper die block 312 of the first mold 31 and the front top rib 3241 of the bottom die block 324 of the second mold 32, the angle forming unit 3 make the metal encaustic tile 12 to have angles 121 and an inwardly curved surface portion 1211 in each angle 121.

As indicated above, the slide 8 is controlled to carry the angle forming unit 3 and the cutting unit 4 on the machine base 9 at a predetermined speed that fits the delivering speed of the corrugated metal sheet 11, therefore, it is not necessary to stop delivering of the continuous sheet of metal sheet material 1 during stamping and cutting operation of the angle forming unit 3 and the cutting unit 4. Therefore, the invention greatly improves the metal encaustic tile fabrication efficiency.

The invention claimed is:

1. A metal encaustic tile making machine of the type comprising a machine base, a corrugation forming roller unit adapted to corrugate a continuous sheet of metal sheet material into a corrugated metal sheet, an angle forming unit adapted to stamp said corrugated metal sheet into a metal encaustic tile having angles that are arranged in parallel and extend across the corrugations of the corrugated metal sheet, said angle forming unit comprising a first mold and a second mold, the first mold and second mold of said angle forming unit each comprising an upper die block holder, an upper die block fixedly fastened to a bottom side of said upper die block holder, a bottom die block holder aimed at said upper die block holder, and a bottom die block fixedly fastened to a top side of said bottom die block holder and facing said upper die block, and a cutting unit adapted to cut the finished metal encaustic tile from said continuous sheet of metal sheet material, the metal encaustic tile making machine further comprising two parallel guide rails provided at said machine base, a slide coupled to and movable along said guide rails and carrying said angle forming unit and said cutting unit on said machine base, a transmission screw pivotally mounted in said machine base, a coupling block fixedly provided at a bottom side of said slide and threaded onto said transmission screw, and a reversible motor mounted inside said machine base and adapted to rotate said transmission screw and to further move said slide with said angle forming unit and said cutting unit on said machine base along said guide rails.

2. The metal encaustic tile making machine as claimed in claim 1, wherein said angle forming unit and said cutting unit are fixedly mounted on a locating plate that is fixedly fastened to said slide at a top side.

* * * * *